United States Patent [19]

Watanabe

[11] Patent Number: 5,016,048

[45] Date of Patent: May 14, 1991

[54] IMAGE FORMING APPARATUS FOR FORMING AN ORIGINAL IMAGE AND AN ADDITIONAL IMAGE

[75] Inventor: Junji Watanabe, Tokyo, Japan

[73] Assignee: Kabushiki Kaisha Toshiba, Kawasahi, Japan

[21] Appl. No.: 454,947

[22] Filed: Dec. 22, 1989

[30] Foreign Application Priority Data

| | | | |
|---|---|---|---|
| Dec. 23, 1988 | [JP] | Japan | 63-325586 |
| Dec. 23, 1988 | [JP] | Japan | 63-325587 |
| Jan. 10, 1989 | [JP] | Japan | 1-2114 |
| Jan. 10, 1989 | [JP] | Japan | 1-2115 |

[51] Int. Cl.[5] ..... G03G 21/00

[52] U.S. Cl. ..... 355/202; 355/71; 355/218; 358/474

[58] Field of Search ..... 355/232, 218, 244, 40, 355/71, 202; 358/474, 480, 481

[56] References Cited

U.S. PATENT DOCUMENTS

| | | | |
|---|---|---|---|
| 4,371,898 | 2/1983 | Nakamura | 355/202 X |
| 4,474,464 | 10/1984 | Kanai et al. | 355/71 |
| 4,490,032 | 12/1984 | Conly et al. | 355/218 |
| 4,731,623 | 3/1988 | Oda et al. | 346/160 |
| 4,905,043 | 2/1990 | Satou et al. | 355/71 |

FOREIGN PATENT DOCUMENTS

| | | | |
|---|---|---|---|
| 0047654 | 3/1987 | Japan | 355/218 |
| 0103663 | 5/1987 | Japan | 355/218 |

OTHER PUBLICATIONS

NP-4835 Manual for Canon (translation attached) Aug. 1988.

*Primary Examiner*—A. T. Grimley
*Assistant Examiner*—William J. Royer
*Attorney, Agent, or Firm*—Banner, Birch, McKie & Beckett

[57] ABSTRACT

An image forming apparatus is provided for forming a first image and a second image on a photosensitive material. The apparatus includes a first light device for emitting light in accordance with the first image which follows a first path so as to be incident on said photosensitive material. A second light device emits light in accordance with the second image which follows a second path so as to be incident on said photosensitive material. A shutter mechanism selectively blocks the light emitted by the first light device. A control device controls the second light device so that the second light device emits light in accordance with the second image onto a shadow portion of the photosensitive material, the shadow portion being formed when the shutter device blocks the light emitted by the first light device. A first motor moves the shutter device in a first direction. A second motor moves the shutter device in a second direction perpendicular to the first direction and moves the shutter device between a first position outside the first path of light from the first light device and a second position within the first path of light for blocking the light emitted by the first light device.

23 Claims, 18 Drawing Sheets

IMAGE FORMING APPARATUS FOR FORMING AN ORIGINAL IMAGE AND AN ADDITIONAL IMAGE

BACKGROUND OF THE INVENTION

1. Field of the Invention

The present invention relates to an image forming apparatus, such as a copying machine, for forming both an original image of an original document and an additional image comprising, for example, the time and date of copying, the author of the original document or a distribution list. More particularly, the present invention relates to an image forming apparatus in which copies of original documents may be produced having additional, operator selected information included thereon.

2. Description of the Related Art

Today, copying machines are standard office equipment and can efficiently copy large numbers of documents in a short time period. Effective organization and management is therefore necessary to handle the copies which are produced. Often, the copies are to be distributed throughout the office in accordance with a distribution list. The copies may, for example, be an excerpt or article from a book or magazine. It is desirable in this instance to provide an indication of the source of the article. It may also be desirable to note the time and date of copying in order to quickly identify later versions of documents, etc. In many instances, these notations and other additional information are handwritten, stamped, or typed on the copies. However, these procedures are time consuming and require the attention of one or more persons.

Electronic copying devices have recently been developed in which such additional information, including, for example, alphanumeric characters, may be formed on paper utilized as the recording medium. In one such device, recording paper having an original image of an original document is transported to an image forming section. An additional image of the additional information, such as alphanumeric characters, is then formed on the recording paper having the original image formed thereon. Thus, two steps are required for the complete image formation, i.e., the step of forming an original image and the step of forming an additional image. Accordingly, the image forming speed of such a copying machine is slower than the corresponding image forming speed of conventional one-step original image formation. Additionally, it is difficult to precisely position the additional image on the recording medium.

Another copying device which permits additional information to be formed uses a shutter, solenoid and spring to form the additional image on a photosensitive drum. This device, however, suffers from the disadvantage of having slow shutter movement with respect to the rotational movement of the image forming photosensitive drum. Consequently, the additional image produced will be larger than necessary and may interfere with the full and complete reproduction of the document being copied.

Commonly owned, application Ser. No. 337,738 filed Apr. 13, 1989, discloses an image forming apparatus for forming an original image and an additional image. That apparatus, however, uses a light emitting diode array. Such arrays have a slow operation time in forming the additional images.

Another type of copying machine has been developed in which an original image is read from an original document and the image data is then converted into an electrical signal. The original image is reproduced using the electrical signal. This type of copying machine is known as a digital copying machine. With digital copying machines such as, for example, laser printers, the additional image can be written on the recording paper while the original image is being copied. However, digital copying machines are more expensive than conventional electronic copying machines.

SUMMARY OF THE INVENTION

Accordingly, it is an object of the present invention to provide an image forming apparatus for efficiently and rapidly forming an original image and an additional image including, for example, alphanumeric characters, onto a desired location on the original image.

It is another object of the present invention to form the additional image in any desired position within the original image.

It is a further object of the present invention to form the additional image at one or more desired positions within the original image.

In accordance with the present invention, an image forming apparatus is provided for forming a first image and a second image on a photosensitive material. The apparatus includes a first light device for emitting light in accordance with the first image, the light following a first path so as to be incident on the photosensitive material. A second light device emits light in accordance with the second image, the light following a second path so as to be incident on the photosensitive material. A shutter mechanism selectively blocks the light emitted by the first light device. A control device controls the second light device so that the second light device emits light in accordance with the second image onto a shadow portion of the photosensitive material, the shadow portion being formed when the shutter device blocks the light emitted by the first light device. A first motor moves the shutter device in a first direction. A second motor moves the shutter device in a second direction perpendicular to the first direction and moves the shutter device between a first position outside the first path of light from the first light device and a second position within the first path of light for blocking the light emitted by the first light device.

BRIEF DESCRIPTION OF THE DRAWINGS

Other objects and many of the attendant advantages of this invention will be readily appreciated as the invention becomes better understood by reference to the following detailed description when considered in connection with the accompanying drawings, in which like reference characters designate the same or similar parts throughout.

DETAILED DESCRIPTION OF THE PREFERRED EMBODIMENTS

Figure 1:
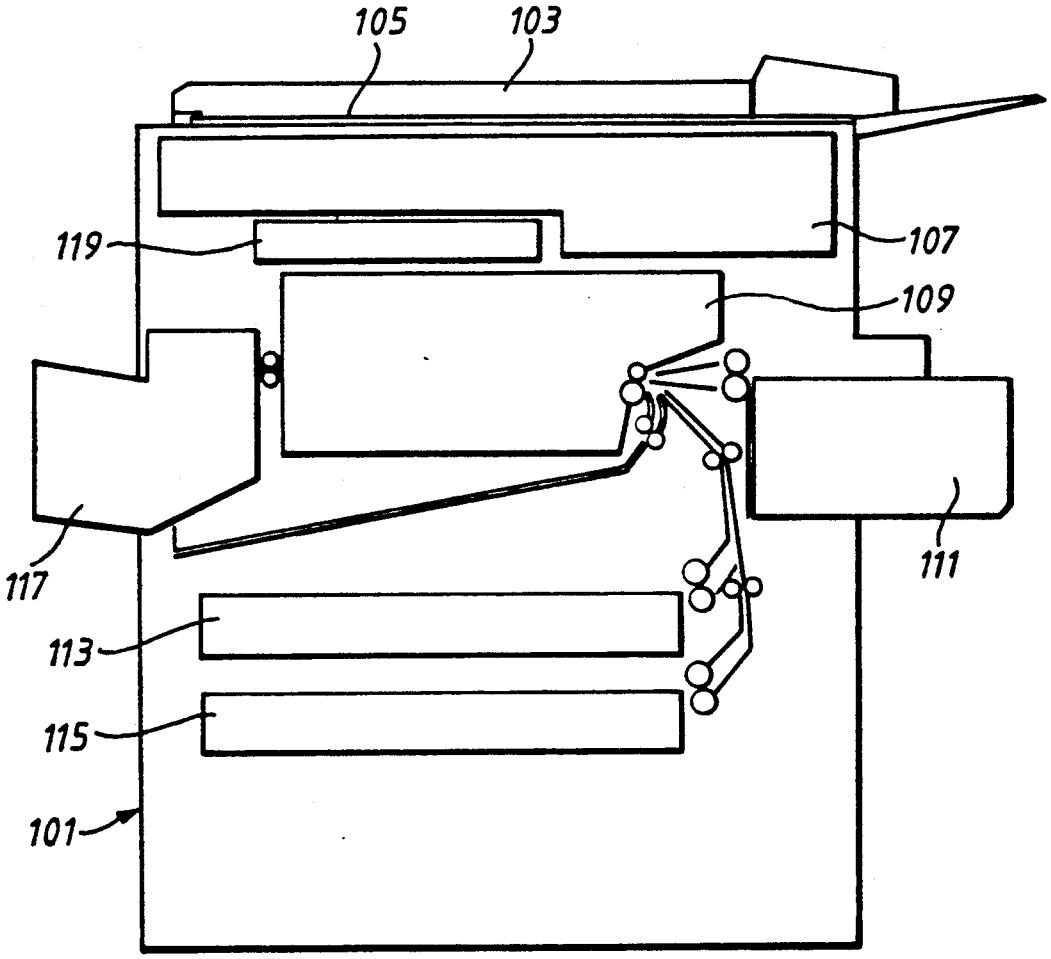
FIG. 1 is a schematic sectional view of a copying machine according to one embodiment of the present invention.
Figure 2:
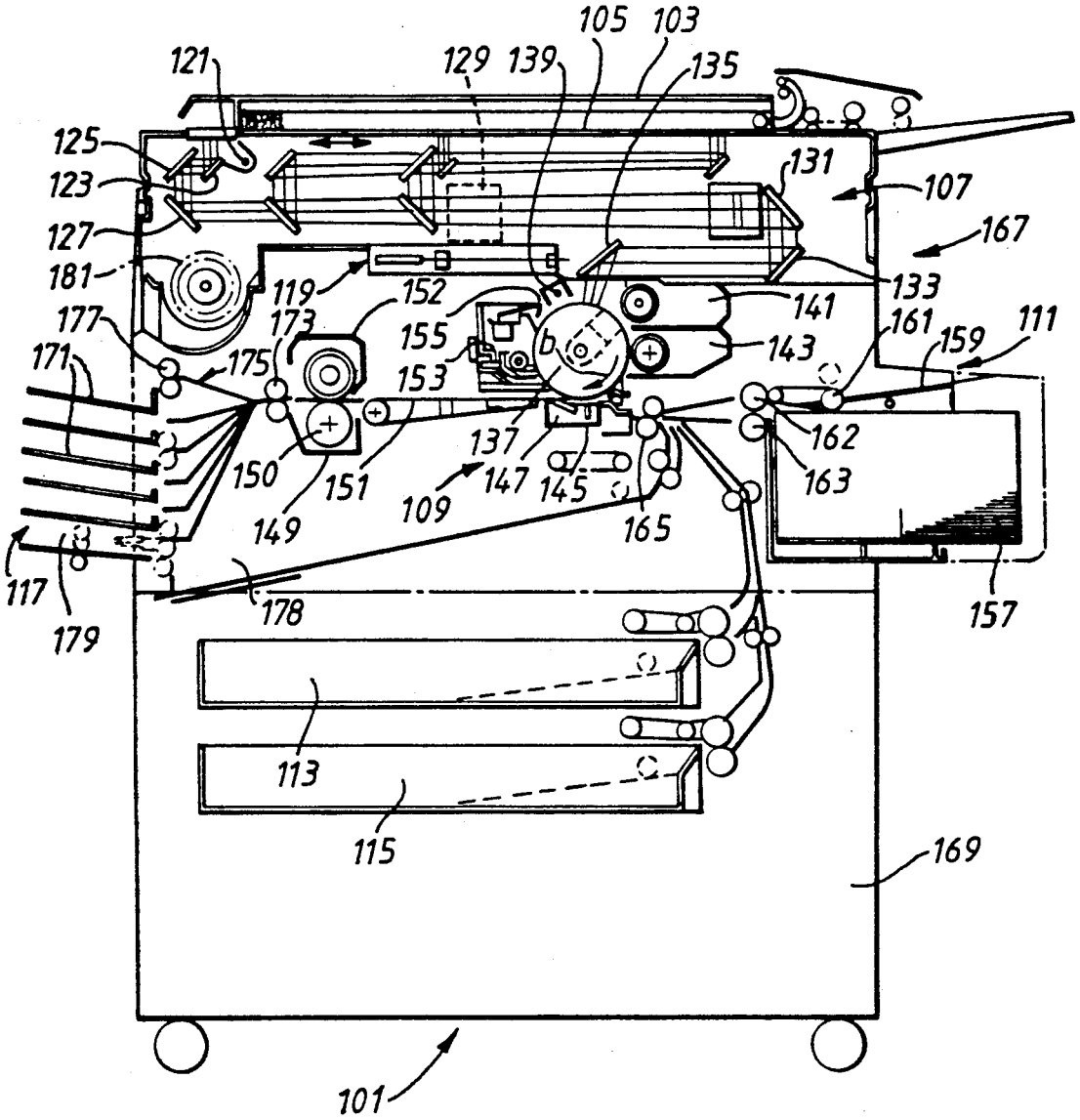
FIG. 2 is a detailed sectional view of the copying machine shown in FIG. 1.

FIG. 1 illustrates an image forming apparatus, such as a copying machine, in accordance with the present invention. The image forming apparatus includes a main body 101 which is divided into copying unit 167 and desk unit 169 as shown in FIG. 2. Copying unit 167 will now be described.

Cover 103 is hinged at one side of the top of main body 101 for permitting access to an original table 105 of transparent glass, for example, which receives the original document to be copied. Original table 105 is positioned on the top of main body 101 for supporting the original document to be copied.

Main body 101 includes a copying optical unit 107 which is positioned below original table 105 and produces optical information such as reflected light from the original document. This optical information is processed and copied onto paper at developing unit 109. The paper is supplied from either large capacity feeding unit (hereinafter LCF) 111, first cassette 113 or second cassette 115. LCF 111 preferably can contain a large number of sheets of paper, e.g., five hundred sheets of paper. First and second paper cassettes 113 and 115 contain a smaller number of sheets than LCF 111, e.g., fifty sheets of paper, of the same or different size as the paper in LCF 111.

The copy containing visible information is supplied from developing unit 109 to a sorting unit 117. Sorting unit 117 includes at least one receiving tray to receive the copy. Laser unit 119 is positioned between copying optical unit 107 and developing unit 109. Laser unit 119 produces a laser beam in accordance with digital information supplied by an operator. The operator information (i.e., additional information) is entered through a panel (not shown in FIG. 1).

The above-described copying machine is able to provide a copy of the original document having additional information written thereon. As described above, this operator selected additional information may comprise the time and date of copying, a distribution list, etc. The additional information may comprise alphanumeric characters, although any type of characters may be used and the invention is not limited in this respect.

The details of the system are discussed below. FIG. 2 illustrates copying optical unit 107 which includes a lamp 121 for illuminating an original document on original table 105. The light reflected from the original is then reflected by mirrors 123, 125 and 127 in successive order. The light from mirror 127 passes through lens block 129 for varying the magnification, and is then reflected by mirrors 131, 133 and 135 before being directed to a photosensitive drum 137 within developing unit 109. As will be described in greater detail below, mirror 135 is movable in and out of an optical path between the document and the surface of photosensitive drum 137 by a driving mechanism (See FIG. 11).

Lamp 121 and mirror 123 are positioned on a first carriage (not shown) and mirrors 125 and 127 are positioned on a second carriage (not shown). The first and second carriages are located under original table 105 and are reciprocatingly movable in the direction of arrow "a". The second carriage is moved at a speed equal to one-half the speed of the first carriage in order to maintain a predetermined optical length during copying, i.e., in order to keep the length of the path of reflected light from the original document on original table 105 to photosensitive drum 137 constant.

Developing unit 109 includes photosensitive drum 137. The light output from copying optical unit 107 is directed to the surface of photosensitive drum 137 and a latent image is formed in response to light incident thereon. Photosensitive drum 137 is rotated in the direction indicated by arrow "b". As drum 137 is rotated, a portion of the drum surface passes under main charger 139. Main charger 139 functions to charge the surface of photosensitive drum 137. The latent image is formed by the exposure of the charged surface to the light from copying optical unit 107. As photosensitive drum 137 rotates further, the latent image formed thereon electrostatically attracts two types of toners to thereby form a toner image. The toners are supplied from first and second developing cartridges 141 and 143. First and second developing cartridges 141 and 143 contain different color toners, e.g., black and red toners, although other color toners may be utilized. First and second developing cartridges 141 and 143 are removably attached to main body 101 of the copying machine. The side walls of the respective developing cartridges 141 and 143 preferably have bar code information (not shown) written thereon to indicate the color of the toner. A sensor (not shown) fixed to main body 101 senses the bar code information to recognize the color of the toner.

As photosensitive drum 137 rotates further, the toner image reaches a transfer section in which transfer charger 145 faces photosensitive drum 137. In the transfer section, paper from either LCF 111, first cassette 113 or second cassette 115 closely contacts the surface of photosensitive drum 137 under transfer charger 145. Transfer charger 145 charges the toner on the surface of photosensitive drum 137 so as to transfer the toner image to the paper.

The paper is then transported to a separation charger 147 by the further rotation of photosensitive drum 137. Separation charger 147 electrostatically separates the paper having the transferred image from photosensitive drum 137.

The paper is then transported to fixing unit 149 by transfer belt 151. Heating roller 150 of fixing unit 149 applies heat to the toner image on the paper. The toner image is fixed on the paper through the application of heat from heating roller 150 and the pressure on the paper due to pressure roller 152 and heating roller 150. The paper with the fixed toner image is passed from developing unit 109 to sorting unit 117 by fixing-exit rollers 173.

After the toner image is transferred onto the paper, photosensitive drum 137 rotates further to pass under cleaner unit 153 and discharging unit 155. Cleaner unit 153 removes residual toner from the surface of photosensitive drum 137. Discharging unit 155 removes residual charge from the surface of photosensitive drum 137. After passing cleaner unit 153 and discharging unit 155, the surface of photosensitive drum 137 is restored to an initial state.

LCF 111 is a conventional large capacity feed unit and is located in main body 101. LCF 111 includes side cover 157 which may be opened to load paper. LCF 111 further includes slanted top cover 159. A gap is left between main body 101 and top cover 159 to permit paper to be manually fed to the copying machine.

The top paper stored in LCF 111 is picked up by a supply roller 161. The paper is then fed between separating rollers 162 and 163. Separating rollers 162 and 163 ensure that only a single sheet of paper is withdrawn from LCF 111, as is well-known. The paper is then fed to a pair of aligning rollers 165. Aligning rollers 165 align the top end of the paper with photosensitive drum 137 and also feed the paper into the transfer section synchronously with the rotation of photosensitive drum 137.

First and second cassettes 113 and 115 are installed in desk unit 169 of main body 101. Copying unit 167 includes the elements described in detail above other than cassettes 113 and 115. Paper from cassettes 113 and 115 is fed toward aligning rollers 165.

Sorting unit 117 includes a plurality of receiving trays 171 fixed in main body 101. The paper transported from developing unit 109 is discharged into one of receiving trays 171 through fixing-exit rollers 173, guide device 175 and exit rollers 177. Exit rollers 177 may be aligned with any of the receiving trays 171 to discharge paper therein. To permit the movement of exit rollers 177, guide device 175 is extendable, such as by telescoping, such that exit rollers 177 may be aligned with the various receiving trays 171.

A turn-over roller 179 is positioned over the lowest receiving tray 171 and is movable between an upper position and a lower position. When in its lower position, turn-over roller 179 rotates reciprocally to position the paper onto a stacker 178. The paper on stacker 178 is again fed into developing unit 109 so as to permit copying on both sides of the paper. Cooling fan 181 is located between trays 171 and optical unit 107 for blowing air throughout main body 101.

Figure 3:
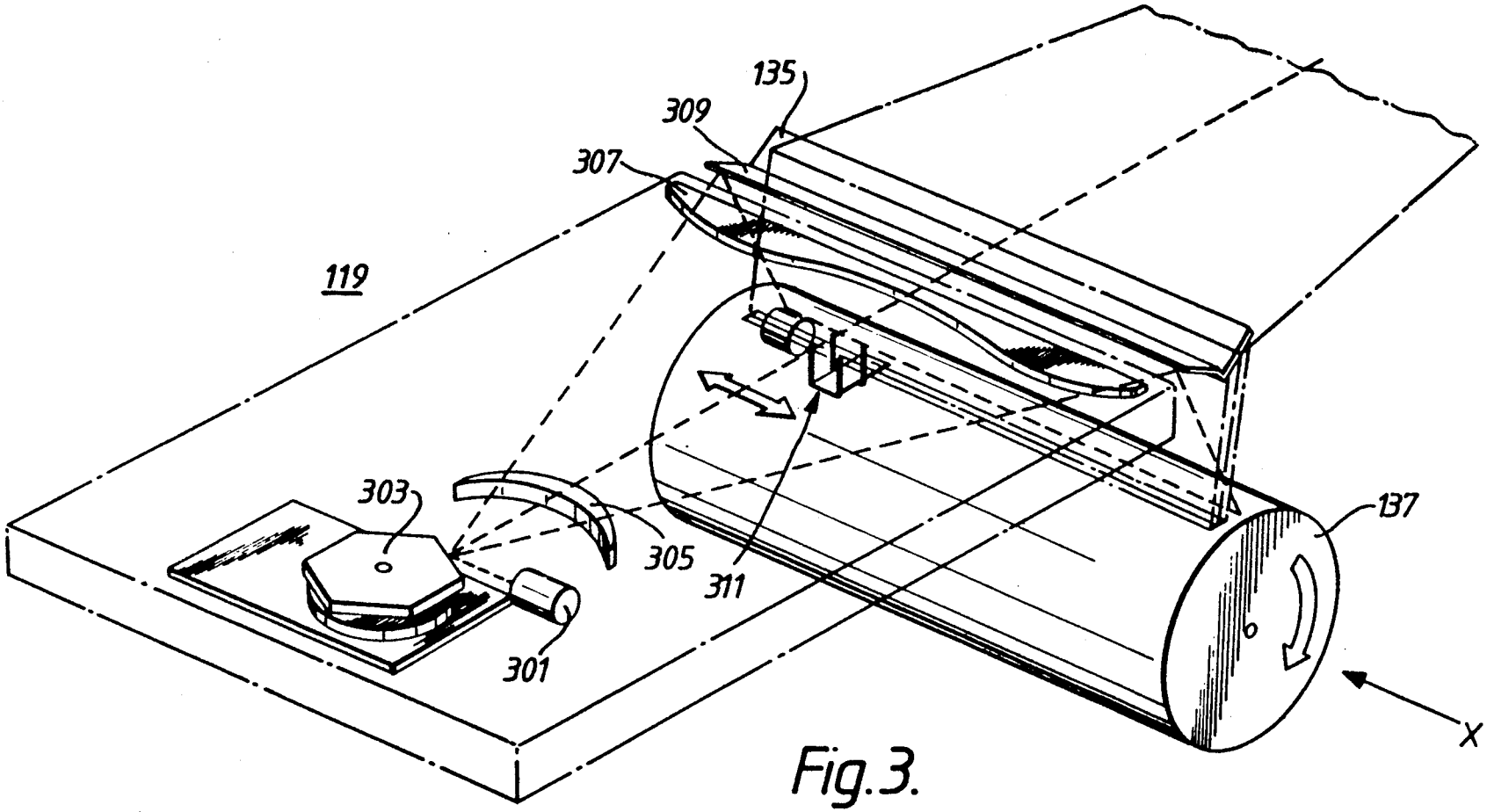
FIG. 3 is a perspective view of a laser unit and a photosensitive drum used in the copying machine shown in FIG. 1.

FIG. 3 illustrates laser unit 119 which includes laser diode 301 which emits a collimated laser beam. The collimated laser beam is reflected by polygonal mirror 303. Polygonal mirror 303 has a plurality of reflecting surfaces and is rotated such that the laser beam reflected therefrom is moved over the surface of photosensitive drum 137 at a constant speed. The laser beam is focused by lenses 305 and 307 and reflected onto photosensitive drum 137 by first reflecting mirror 309, as more clearly shown in FIGS. 6 and 7. The details of laser unit 119 are disclosed in U.S. Pat. No. 4,731,623, which is incorporated herein by reference. First reflecting mirror 309 may be moved out of the laser beam path so that the beam may be focused on original table 105 as will be discussed below in detail with reference to FIG. 11.

A shutter unit 311 is selectively positioned in the optical path of reflected light from the original document to the surface of photosensitive drum 137 via mirror 135. The optical path of the reflected light from the original document (hereinafter referred to as "optical path") intersects the path of the laser beam (herein after referred to as "laser path") from first reflecting mirror 309 to the surface of photosensitive drum 137.

Figure 4:
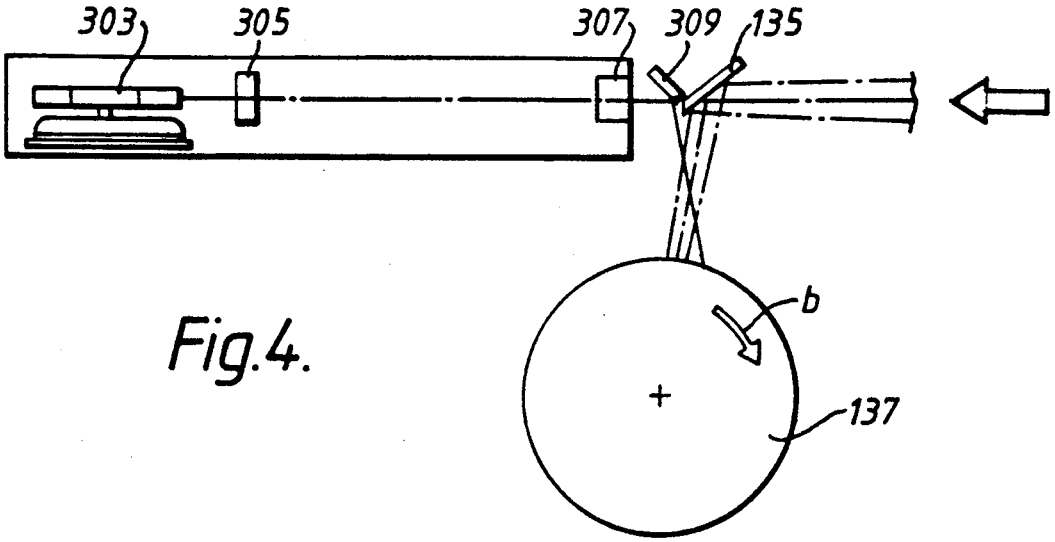
FIGS. 4, 5, 6 and 7 are side views of the laser unit and the photosensitive drum used in the copying machine shown in FIG. 1.

FIG. 4 illustrates the relationship of the laser path and the optical path. As shown, an optical axis of the laser path is aligned or coincident with an optical axis of the optical path. However, the laser path intersects photosensitive drum 137 at a point different than where the optical path intersects photosensitive drum 137.

Figure 5:
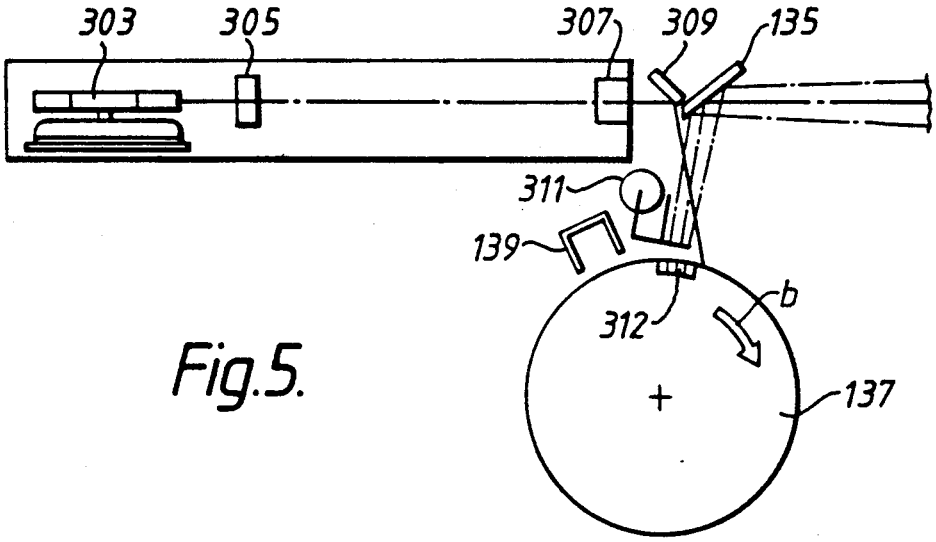

FIG. 5 illustrates the relationship of shutter unit 311 with respect to the laser path and the optical path. Shutter unit 311 selectively blocks the optical path so that light from the optical path is not incident on the surface of photosensitive drum 137 and a shadow portion 312 is formed thereon. As the shadow portion 312 is rotated from under shutter unit 311, the laser beam will be incident thereon.

Figure 6:
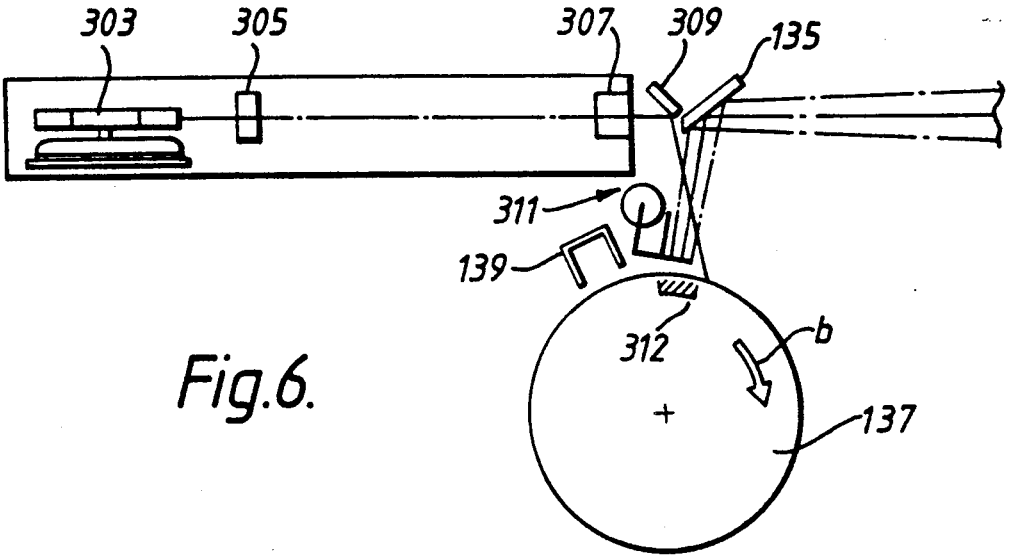
Figure 7:
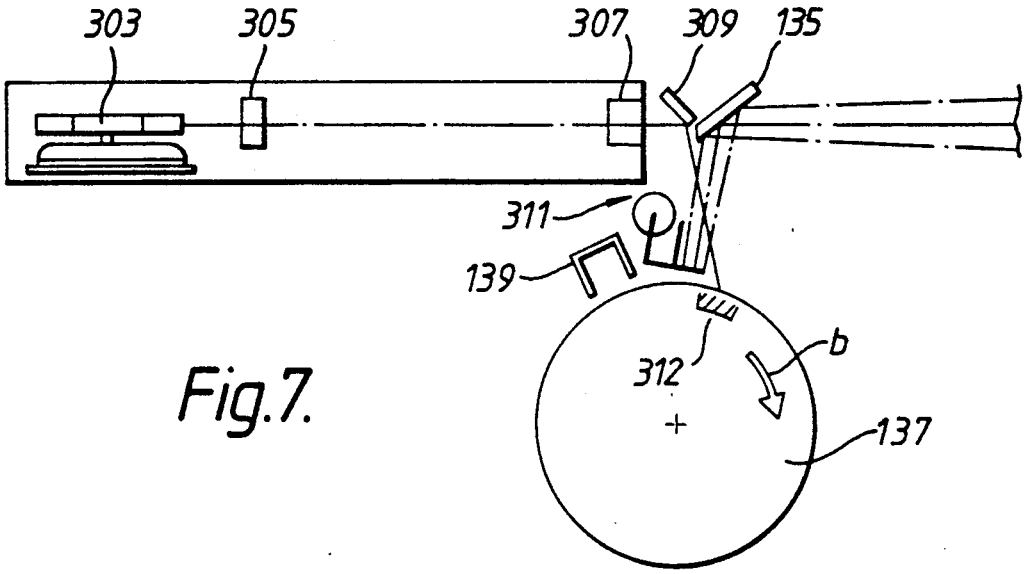

Before a time $t_0$, if the optical path is not blocked by shutter unit 311, the reflected light from the original document is incident on the surface of photosensitive drum 137. At time $t_0$, shutter unit 311 blocks the optical path so that the shadow portion 312 is formed as shown in FIGS. 5 and 6. At a time $t_1$ ($t_1 > t_0$), as photosensitive drum 137 rotates, the shadow portion 312 is moved and the laser beam is incident thereon as shown in FIG. 7. Thus, additional information in accordance with the laser beam may be written on the shadow portion 312.

Figure 8:
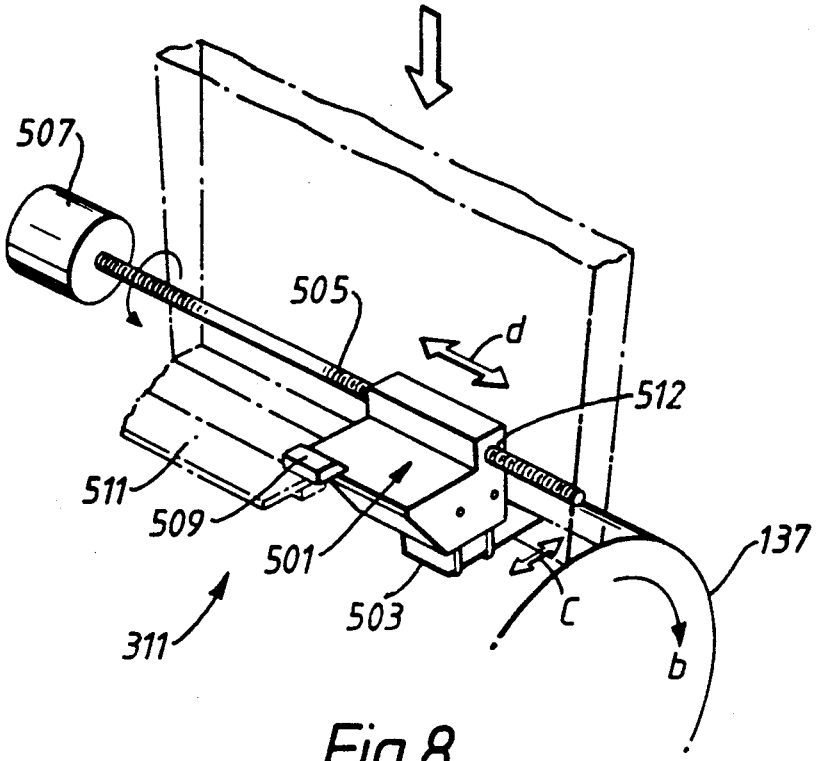
FIG. 8 is a perspective view of a shutter unit used in the laser unit shown in FIG. 3.

As shown in FIG. 8, shutter unit 311 includes a shutter driver 501 to move shutter 503 in the direction indicated by arrow "c" in FIG. 5. Shutter driver 501 is moved in the direction indicated by the arrow "d". The direction indicated by the arrow "d" is perpendicular to the direction indicated by the arrow "c".

Shutter unit 501 includes a threaded opening 512 formed through an upper portion thereof. A threaded rod 505 is inserted into threaded opening 512. One end of rod 505 is coupled to a rotational axis of pulse motor 507. Pulse motor 507 is disposed out of the optical path and the laser path. Pulse motor 507 rotates to move shutter driver 501 in a predetermined path above the surface of photosensitive drum 137.

Shutter unit 311 includes guide portion 509 which is parallel to rod 505. Guide portion 509 projects outward in a direction perpendicular to rod 505 and slides on a guide rail 511, the guide rail being arranged parallel to a rotational axis of photosensitive drum 137. Guide rail 511 is arranged over photosensitive drum 137. Guide portion 509 and guide rail 511 cooperate to guide shutter driver 501.

Figure 9:
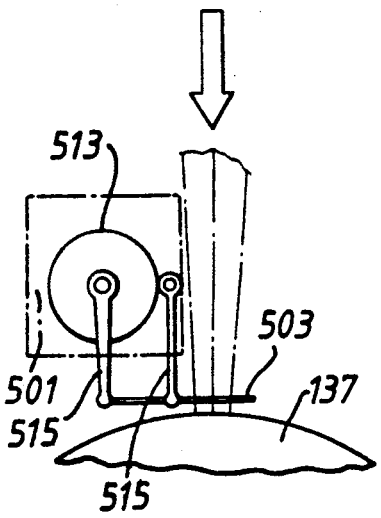
FIGS. 9 and 10 are sectional views of the shutter unit shown in FIG. 8.

As shown in FIG. 9, shutter driver 501 includes a pulling pulse motor 513 to drive shutter 503. Shutter 503 is supported by shutter driver 501 through four levers 515. One end of a first lever 515 is coupled to a rotational axis of pulling pulse motor 513. The other levers 515 are rotatably coupled to the body of shutter driver 501. Each of the levers 515 is rotatably coupled to shutter 503.

Figure 10:
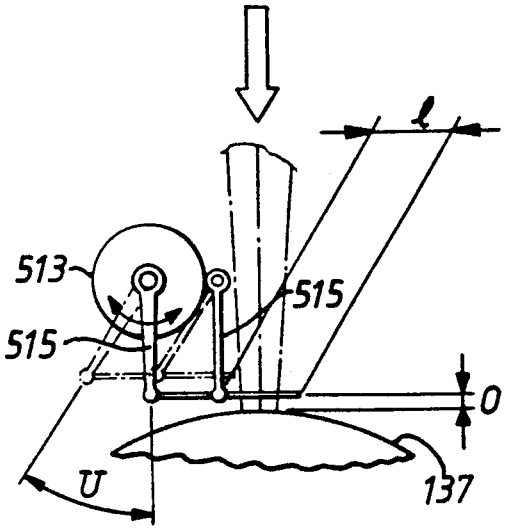

With reference to FIG. 10, when the additional information is written by the laser beam, shutter 503 is positioned over photosensitive drum 137 with a predetermined gap o therebetween so that shutter 503 forms shadow portion 312 on the surface of photosensitive drum 137. Hereinafter this position is referred to as shadow position. Shutter 503 does not come into contact with the surface of photosensitive drum 137. The predetermined gap o is the smallest spacing between photosensitive drum 137 and shutter 503.

At that time, if the reflected light from the original is directed toward the shadow position, shutter 503 blocks the optical path so that a latent image is not formed at the shadow portion on photosensitive drum 137. Except when in the shadow position, shutter 503 is rotated counterclockwise by an angle U. Thus, shutter 503 is moved out of the optical path so that the latent image is formed if the reflected light of the original document is incident onto the surface of photosensitive drum 137.

Shutter 503 may be moved to the shadow position easily and quickly since it is driven directly by pulling pulse motor 513. Advantageously, this permits high speed copying. Further, high speed shutter movement minimizes the size of the shadow region and reduces the possibility that the additional image will interfere with the full and complete reproduction of the document being copied.

Figure 11:
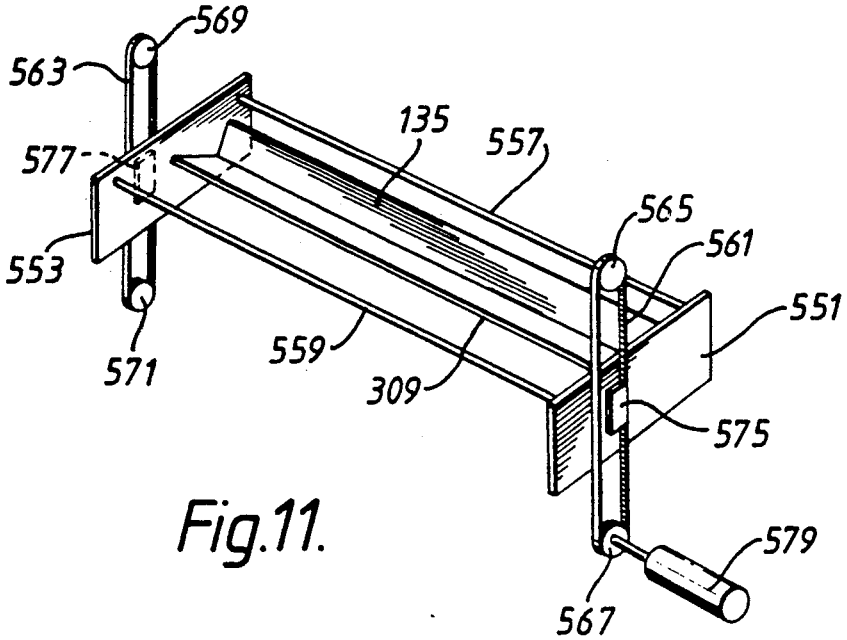
FIG. 11 is a perspective view of a driving mechanism for a mirror and a first reflecting mirror used in the copying machine shown in FIG. 2.

FIG. 11 illustrates the driving mechanism of mirror 135 and first reflecting mirror 309. Both mirror 135 and 309 are secured to plates 551 and 553. Supporting rods 557 and 559 are provided between plates 551 and 553 in order to reinforce the structure of mirrors 135 and 309 and plates 551 and 553. Toothed belts 561 and 563 are provided along the outer surfaces of plates 551 and 553, through a pair of gears 565 and 567 and a pair of gears 569 and 571 respectively. These gears 565, 567, 569 and 571 are fixed to main body 101. Toothed belts 561 and 563 are geared to teeth of projections 575 and 577, which are fixed to the surface of plates 551 and 553. Gear 567, which engages the teeth of toothed belt 561, is rotated by a pulse motor 579.

When pulse motor 579 rotates, plates 551 and 553 are moved upward or downward through toothed belts 561 and 563. The rotation of pulse motor 579 is controlled so that the position of plates 551 and 553 is correspondingly adjusted.

Figure 12:
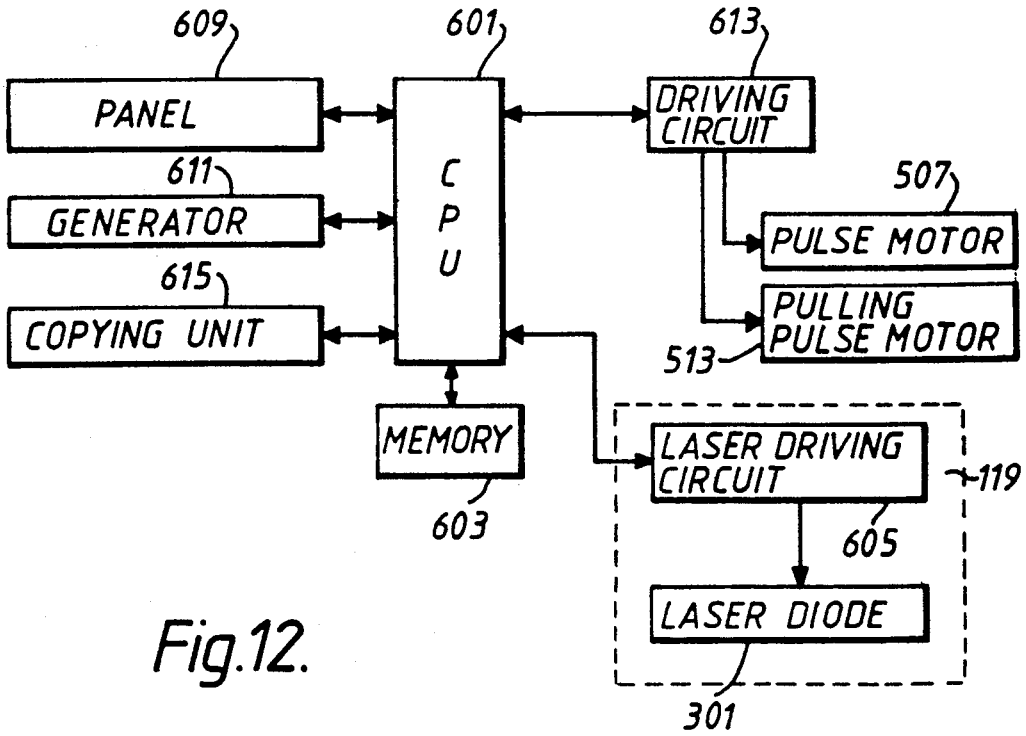
FIG. 12 is a block diagram of an electrical system used in the copying machine shown in FIG. 1.

Referring now to FIG. 12, the electrical system of the copying machine illustrated in FIGS. 1 and 2 includes a CPU 601 for controlling copying machine in accordance with a program stored in a memory 603. CPU 601 is coupled to copying unit 615. CPU 601 is electrically coupled to laser unit 119 which includes a laser driving circuit 605 for driving laser diode 301. As described above, laser unit 119 is used to write the additional information, which is input through panel 609. Panel 609 is disclosed in U.S. application Ser. No. 337,738, filed Apr. 13, 1989, which is incorporated herein by reference. The operator inputs both the additional information to be formed on the copy and position data where the additional information is to be formed on the copy. The additional information preferably consists of alphanumeric characters such as the time and date, the author of the document being copied, distribution lists, etc. although the invention is not limited in this respect. The additional information and the position data are sent to CPU 601. CPU 601 reads digital data corresponding to each character of the additional information from a generator 611. CPU 601 sends this digital data to laser driving circuit 605. Laser driving circuit 605 controls the ON/OFF switching of laser diode 301 in accordance with the high or low level of the digital data.

CPU 601 also controls the position at which laser unit 119 forms the additional information on the copy by using the position data. CPU 601 sends the position data to driving circuit 613. Driving circuit 613 is coupled to pulse motor 507 and pulling pulse motor 513. Driving circuit 613 controls pulse motor 507 so that shutter driver 501 is moved to the position at which the additional information is to be formed on the copy. Driving circuit 613 also controls pulling pulse motor 513 so that shutter 503 is located in the shadow position only at the position where the additional information is to be formed.

Thus, when forming the latent image, shutter 503 blocks the optical path so that the shadow portion is formed on the surface of the photosensitive drum 137 at the writing position. When photosensitive drum 137 is rotated for the time $(t_1 - t_0)$, laser diode 301 generates the laser beam which is directed onto the shadow portion.

As described above, generator 611 stores the data representing the characters. The character data is typically stored in generator 611 at the time of manufacture.

Figure 13:
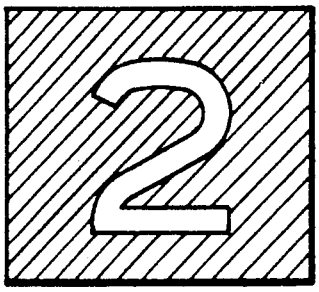
FIG. 13 illustrates a signal configuration produced by a generator used in the electrical system shown in FIG. 12.

Referring to FIG. 13, an example will be explained. FIG. 13 illustrates the numeral 2 on a background which is represented by cross-hatching. The background is represented by a binary "1" signal while the image-bearing portion (i.e., the numeral 2) is represented by a binary "0" signal. The image-bearing and the non-image-bearing (i.e., background) portions are hereinafter referred to as the beam area. A binary "0" signal indicates that laser diode 607 is switched off. A binary "1" signal indicates that laser diode 607 is switched on.

Memory 603 stores both the control program for controlling the copying machine and the data which is generated during the copying operation. This data, for example, includes the additional information and the position data, which are input by operating panel 609, and are stored temporarily in memory 603.

Figure 14:
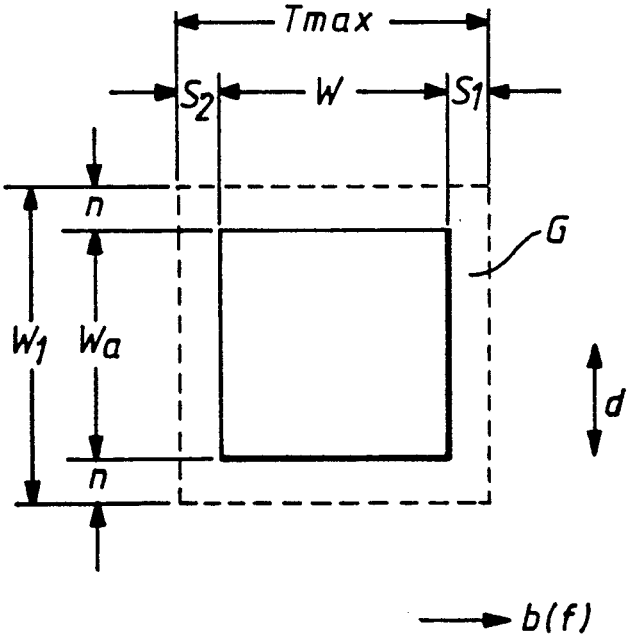
FIG. 14 illustrates the relation between the size of the image in accordance with an additional image made by the laser unit shown in FIG. 3 and the size of a shutter used in the shutter unit shown in FIG. 8.

Referring now to FIG. 14, the relation between the size of the image in accordance with the additional information and the size of shutter 503 will be explained. In the present embodiment, in order to form the image of the additional information, the laser beam is directed over beam area G. Beam area G is preferably larger than the shadow made by shutter 503. This is explained in detail below.

As described above, shutter 503 blocks the optical path so that a portion of photosensitive drum 137, i.e., the shadow portion, fails to receive the reflected light from the original document. Toner adheres to the shadow portion, which, as noted, is not exposed to the reflected light. Thus, a boundary line between the exposed portion and the non-exposed portion is defined by the toner. In order to eliminate this boundary, the laser beam must be directed over an area greater than the area defined by the boundary.

As described above, the laser beam is directed over the beam area G which includes the non-image-bearing portion and the image-bearing portion as described with respect to FIG. 13. If the area upon which the laser beam is incident includes the shadow portion, the laser beam is necessarily directed over the boundary line, except at the image-bearing portion. If the size of the area irradiated by the laser beam is smaller than that of the shadow, the boundary is formed between the irradiated area and the shadow. The boundary is made visible by the toner. In order not to form an unnecessary toner image on photosensitive drum 137, it is necessary that beam area G be larger than the shadow portion.

Referring now to FIG. 14, the length of the shadow in the direction of the arrow d in FIGS. 8 and 14 is referred to as shadow length Wa. The length of shutter 503 in the direction of the arrow c in FIG. 8 is referred to as width W. The dimension of beam area in the direction of the arrow d is referred to as laser area length $W_1$. Laser area length $W_1$ is larger than the shadow length $W_a$ by the distance of n at the both sides.

The width of the shadow and the width of shutter 503 in the direction of the arrow "c" in FIG. 8 will be explained later.

The operation of the copying machine according to the present embodiment will be explained.

Figure 15:
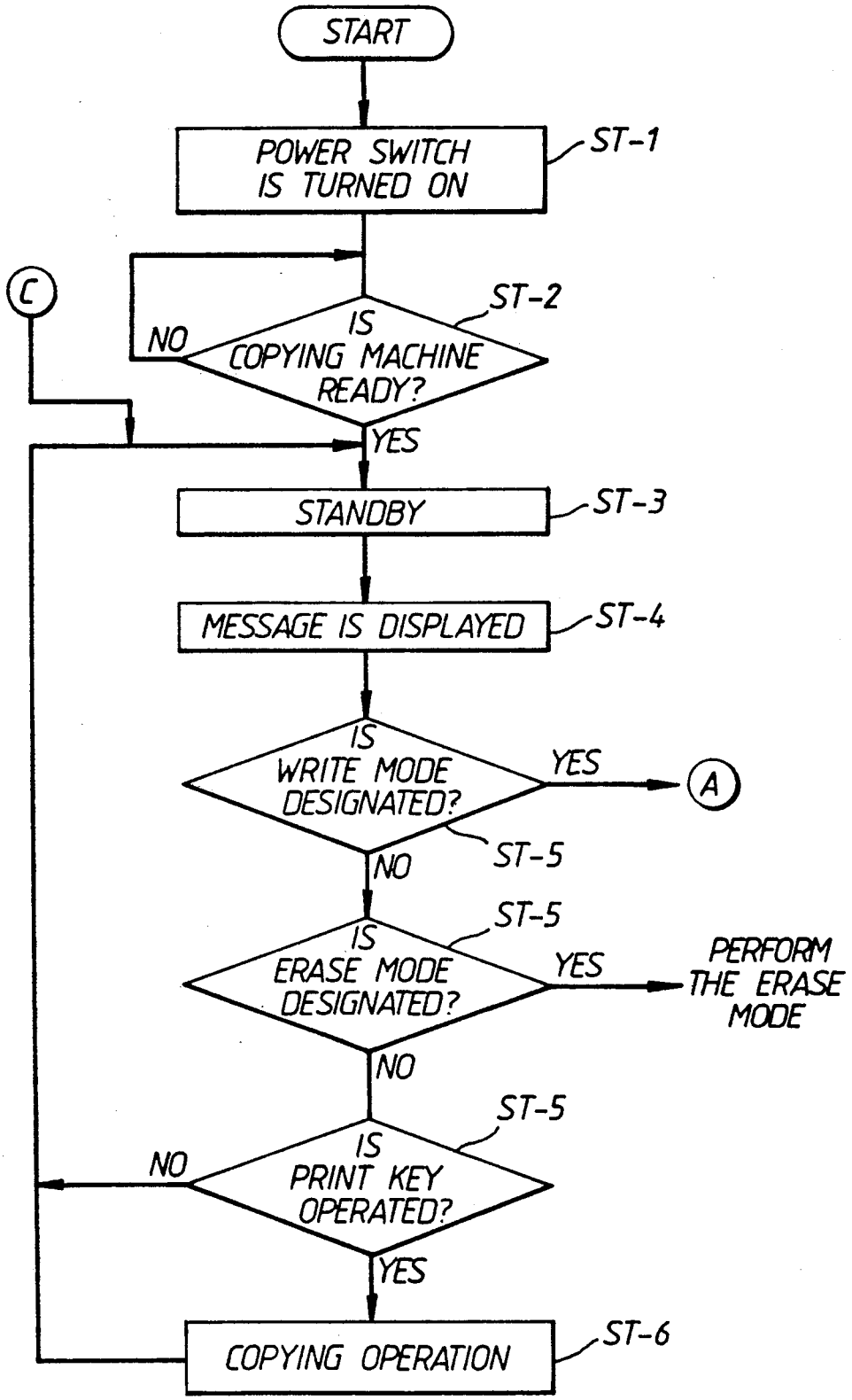
FIG. 15 and 16 are flow charts illustrating the operation of the electrical system shown in FIG. 12.

Referring now to FIG. 15, initially, a power switch (not shown) is turned on so that the components of the copying machine, e.g., a heater of fixing unit 149 and so on, are powered (ST-1). CPU 601 determines whether copying machine is ready for copying, e.g., the heater is sufficiently heated (ST-2).

When the copying machine is ready for copying, CPU 601 proceeds to a standby condition (ST-3). CPU 601 causes panel 609 to display a message for the operator to designate a mode, e.g., "PLEASE DESIGNATE MODE" is displayed (ST-4). The copying machine includes the following three modes. In a "Normal Copying Mode", the copying machine simply copies the original document on original table 105. In a "Write Mode", the additional information is written on the copy of the original document. In an "Erase Mode", an operator-selected portion of the original image corresponding to the original document is erased. That is, a portion of the original may be "whited-out" on the copy.

One mode of these three modes is designated by the selective actuation of keys on panel 609. CPU 601 determines which mode has been designated (ST-5). CPU 601 controls the copying machine in accordance with the mode designated by the operator. Normal Copying Mode is the default mode, i.e., if the write mode or the erase mode has not been selected and a print key (not shown) is actuated in step ST-5, CPU 601 causes the copying machine to perform the normal copying operation (ST-6). When the copying operation is completed, the copying machine returns to standby condition.

Figure 16:
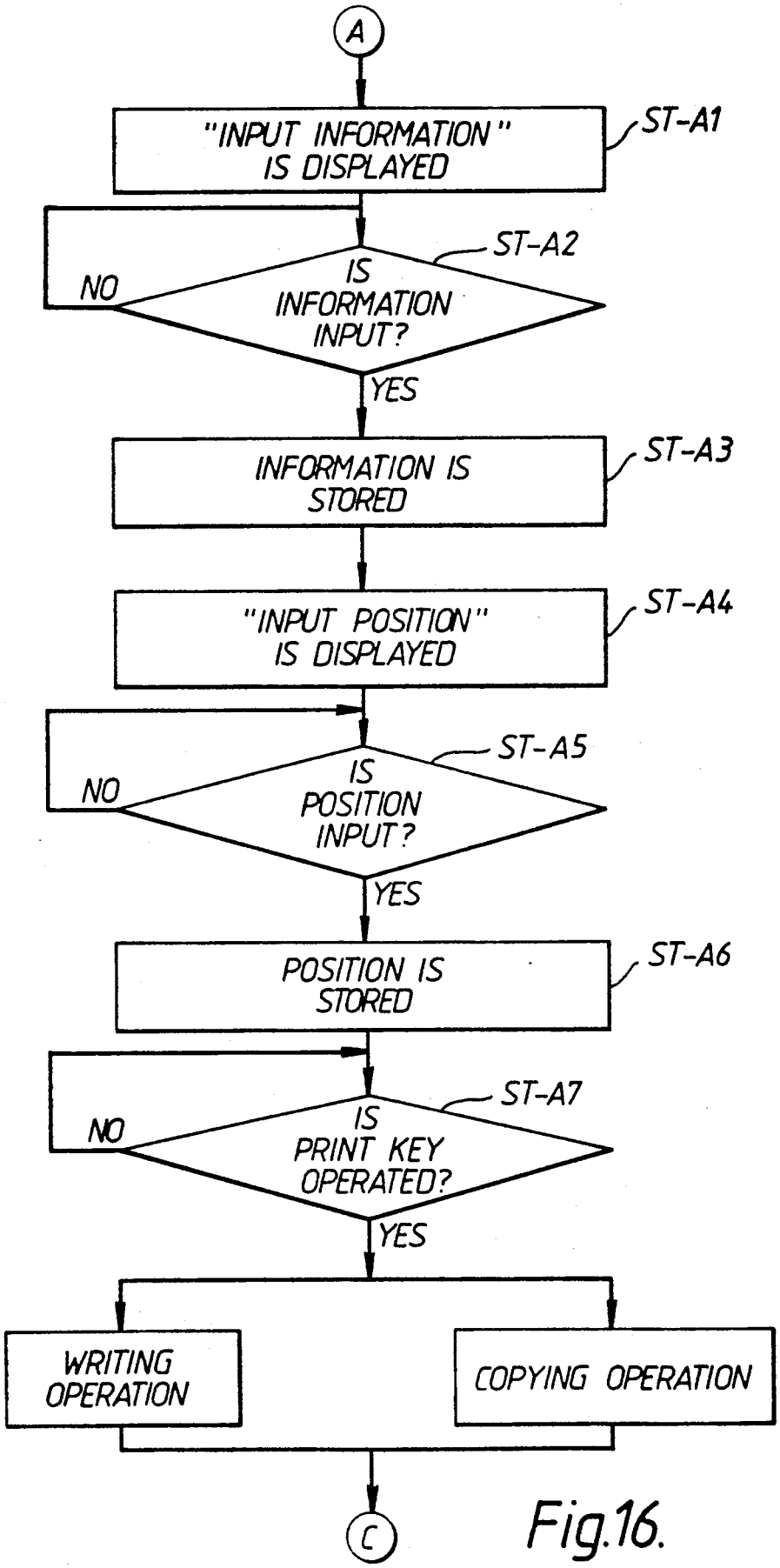

Referring now to FIG. 16, in the write mode, CPU 601 controls panel 609 to display a message prompting the operator to input the additional information (ST-A1). For example, the message displayed on panel 609, may be "INPUT INFORMATION." CPU 601 then determines whether the additional information is input (ST-A2). If the additional information is input, it is stored in memory 603 (ST-A3).

CPU 601 controls panel 609 to display a message prompting the operator to input the position data (ST-A4). CPU 601 determines whether the position data is input (ST-A5). If the position data is input, it is stored in memory 603 (ST-A6). Thus, at step ST-A6, CPU 601 has the information necessary to form the image corresponding to the additional information.

The operator then places an original document on original table 105. CPU 601 determines whether the print key is actuated (ST-A7). If the print key is actuated, both the copying operation and the writing operation are initiated. CPU 601 controls copying unit 615 and laser unit 119 (See FIGS. 1 and 12) in accordance with the control program in memory 603. When the copying operation and the writing operation are complete, CPU 601 returns to the standby condition waiting for the next copy.

The writing operation will be detailed with reference to FIGS. 17–21.

Figure 17:
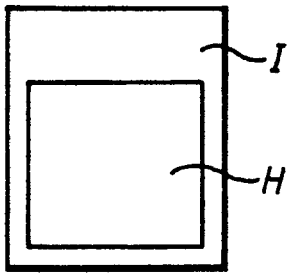
FIGS. 17, 18, 19, 20 and 21 are views illustrating the operation of the shutter unit shown in FIG. 8.
Figure 18:
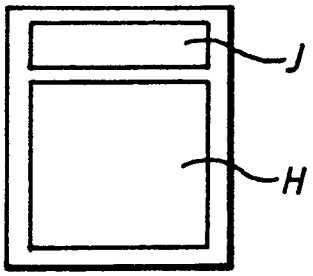

FIG. 17 shows an original document to be copied. The original document includes an image-bearing section H and a background (non-image-bearing) section I. The additional information will be written in an area J as shown in FIG. 18. The position of area J is determined by the operator using panel 609 as described above.

Figure 19:
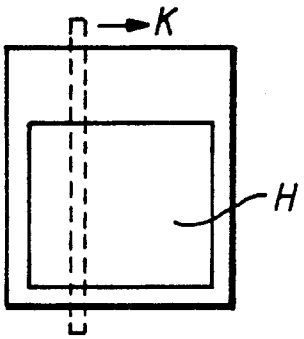

FIG. 19 shows the scanning direction of the document by copying optical unit 107. A strip of light is scanned in the direction of the arrow K in FIG. 19. As the document is scanned, a corresponding strip of the reflected light is scanned on the surface of photosensitive drum 137 in the direction of the arrow b in FIG. 20. The paper sheet P is transported under photosensitive drum 137 in the direction of the arrow M in FIG. 20.

Next, the movement of shutter 503 will be detailed. In response to the actuation of the print key on panel 609, shutter unit 311 is moved parallel to the rotational axis of photosensitive drum 137 by pulse motor 507 (see FIG. 8). During this movement, shutter 503 is kept out of the optical path so that shutter 503 does not block the optical path.

When shutter unit 311 reaches the position designated by the operator for printing the additional information, shutter 503 of shutter unit 311 is moved into the optical path by pulse motor 513 (See FIG. 10) in accordance with the position data. That is, synchronously with the scanning of the area J shutter 503 is moved into the optical path. It takes a time $S_1$ for the shutter to move from the outside of optical path (hereinafter referred to as first position) to within the optical path (hereinafter referred to as second position). Therefore, after a time $S_1$, laser unit 119 starts to emit the laser beam. In the same way, after one character of the additional information is written, shutter 503 is moved back to the first position. It takes a time $S_2$ to move from the second position to the first position.

During the time $(S_1+S_2)$, laser unit 119 does not emit the laser beam to write the additional information. Therefore, if it takes a time $t_0$ for laser unit 119 to emit the laser beam for one alphanumeric character or mark of the additional information, a time $(t_o+S_1+S_2)$ is needed to write the additional information considering the movement of shutter 503.

Figure 21:
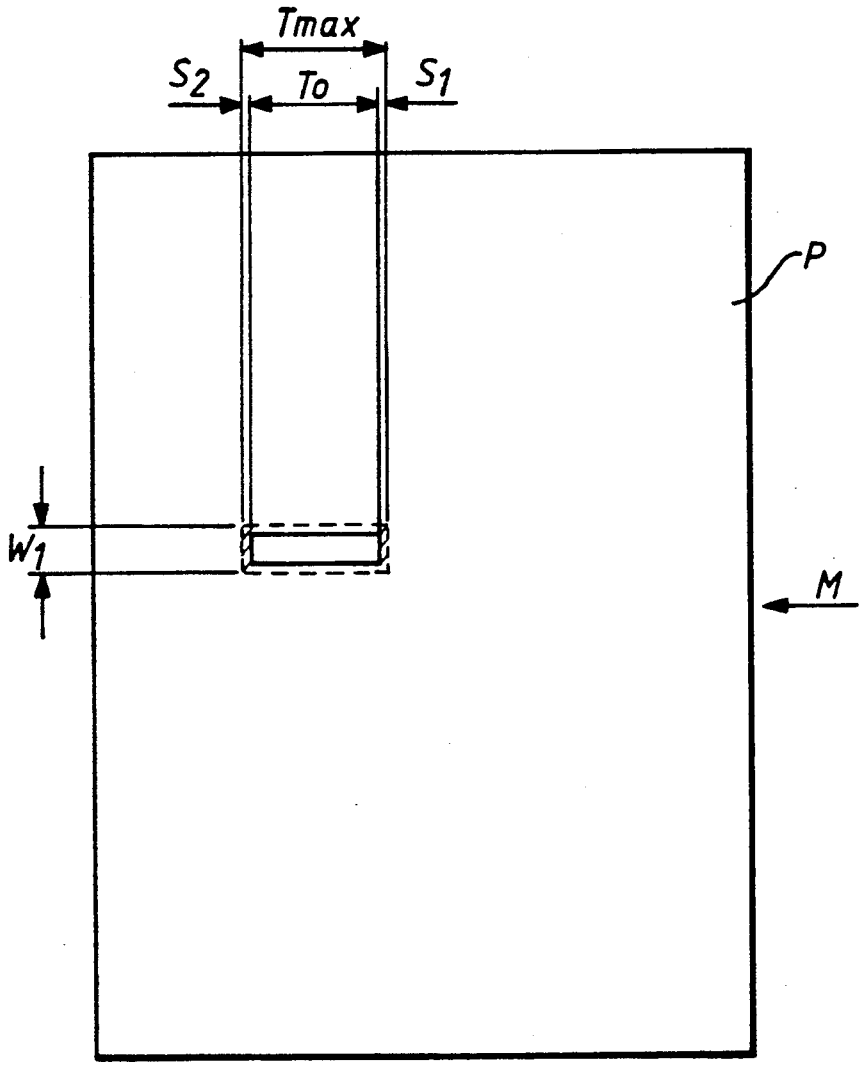

As described above, shutter 503 is moved by pulse motor 513 so that the time $(S_1+S_2)$ is minimized. Experimental results of times $S_1$ and $S_2$ equal to from 5 ms to 10 ms have been achieved. This shutter speed is approximately 10 times faster than prior art systems known to the inventors. As shown in FIG. 21, an area, on which the laser beam is irradiated, extends over the length in accordance with time $t_0$ and the width $W_1$. The light reflected from the original is not irradiated on the area in accordance with the time $(S_1+S_2)$. As the time $(S_1+S_2)$ increases, the area which is not irradiated by the light reflected from the original, indicated by crosshatching in FIG. 21, becomes larger. During the movement of shutter 503, shutter 503 blocks the optical path so that the shadow portion is made. Therefore, if the reflected light is irradiated toward the crosshatched area, shutter 503 blocks the reflected light so that the area to be exposed to the reflected light is not exposed. If the crosshatched region becomes large, portions of the original may not be reproduced in the copy. According to the present embodiment, the time $(S_1+S_2)$ is minimized so that the alteration of the latent image in accordance with the original document is reduced.

The manner in which the position of the additional is determined will now be explained. CPU 601 determines whether the position data is input in step ST-A5 as shown in FIG. 16. Prior to this step, CPU 601 causes pulse motor 579 (see FIG. 11) to rotate. In response to the rotation of pulse motor 579, mirror 135 and first reflecting mirror 309 are moved upward, i.e., out of the optical path and the laser beam path. As shown in FIG. 4, the optical axis of the optical path is coincident with the optical axis of the laser beam path.

When laser diode 607 emits the laser beam, the beam is reflected to original table 105 through the laser beam path and the optical path. A spotlight produced by the laser beam is incident on original table 105 at this time. The document is face-up on original table 105 at this time. The operator is able to see the spotlight through the document.

According to the present embodiment, the position of the spotlight may be moved through panel 609. That is, in response to the actuation of panel 609, CPU 601 adjusts the rotating angle of polygonal mirror 303 and the movement of the first and the second carriage. The operator then selects two positions which determine a rectangle via operating panel 609.

The erase mode will now be explained. The operation of the erase mode is substantially as same as that of the write mode. In the write mode, generator 611 produces data in accordance with the selected alphanumeric character. In the erase mode, data representing spaces are generated by generator 611. Thus, the erase mode is equivalent to a write mode in which spaces are written and the operation is the same as that for the write mode above. An operator may use these spaces to write over or erase portions of the original document.

Figure 22:
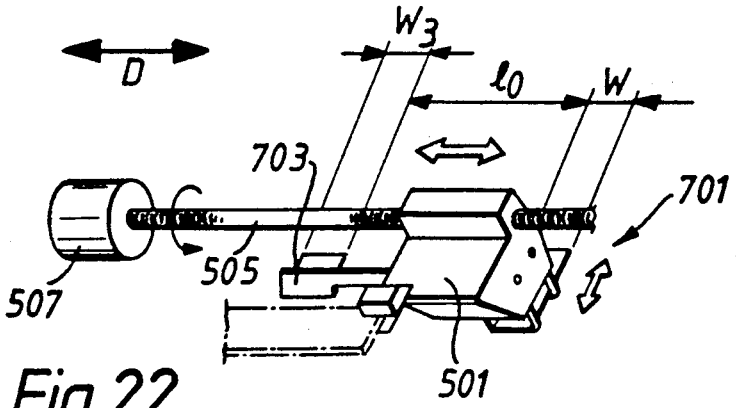
FIGS. 22, 23, 24, 25, 26 and 27 illustrate a second embodiments of the present invention.

Referring now to FIG. 22, another embodiment of the present invention will be explained. The difference between the former and the present embodiments is the structure of shutter unit 701. Shutter unit 701 includes shutter driver 501 with movable shutter 503. Shutter unit 701 further includes fixed shutter 703. Fixed shutter 703 is fixed to shutter driver 501 such that fixed shutter 703 is moved in accordance with the movement of shutter driver 501 in the direction of the arrow D shown in FIG. 22.

Figure 23:
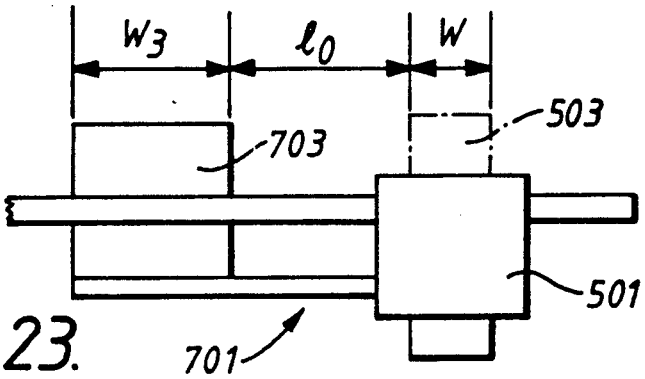
Figure 24:
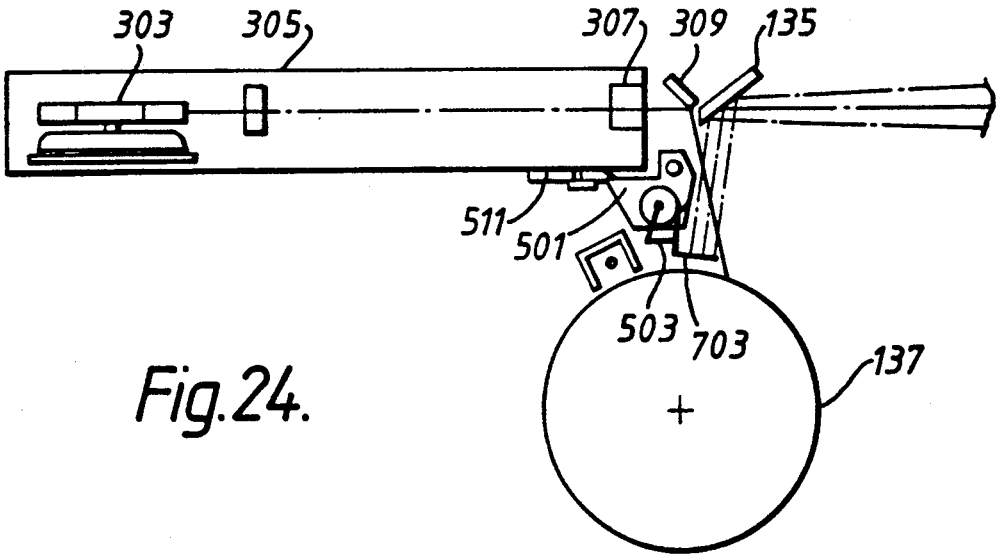

With reference to FIG. 23, fixed shutter 703 is positioned to block the optical path. Even if shutter 503 is moved out of the optical path as shown in FIG. 24, fixed shutter 703 may still block the optical path. Fixed shutter 703 blocks the optical path except when fixed shutter 703 is not located over the surface of photosensitive drum 137.

Figure 20:
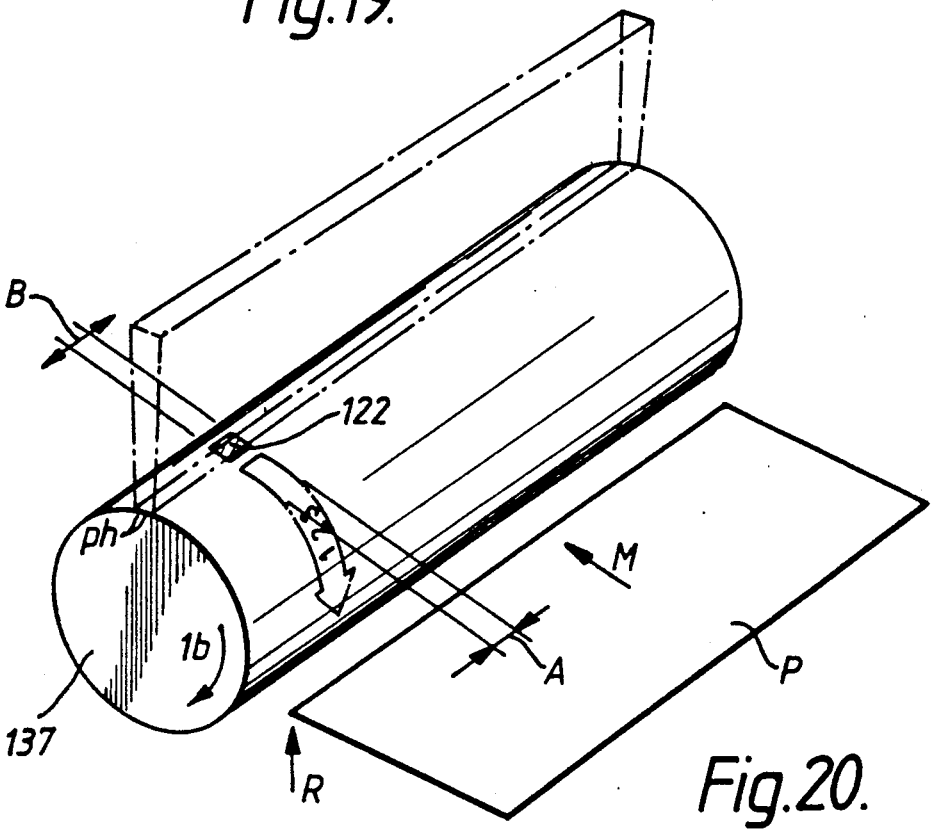
Figure 25:
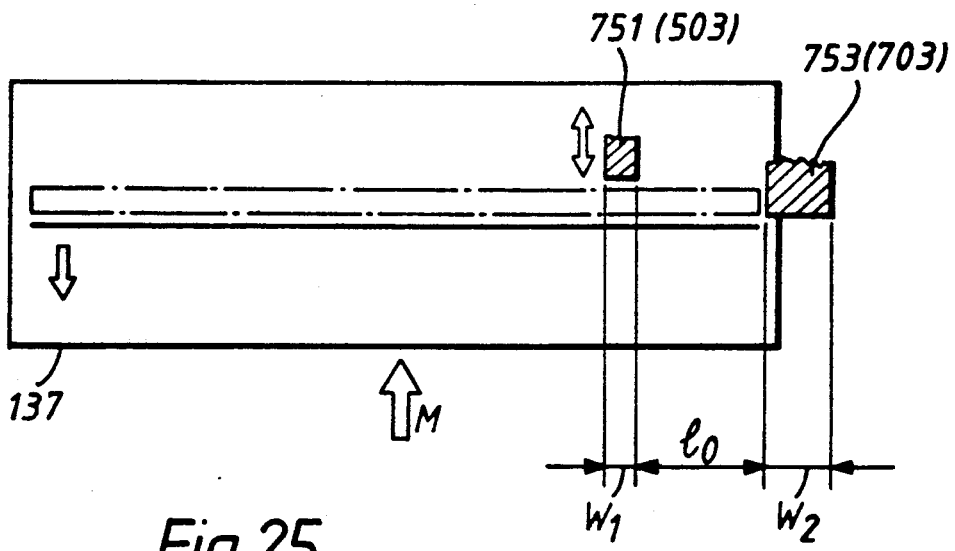
Figure 26:
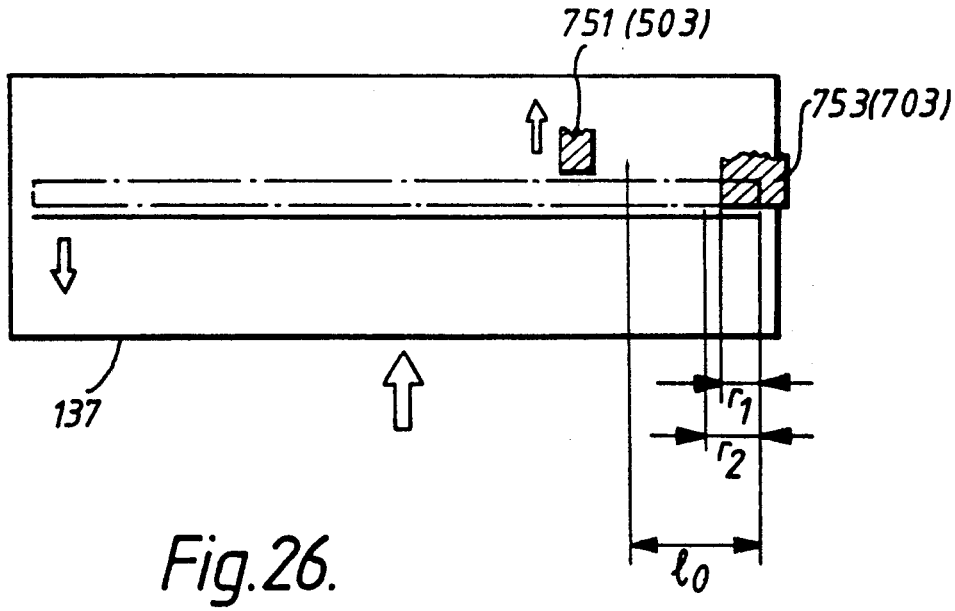

FIGS. 25 and 26 show plan view of photosensitive drum 137 in the direction of the arrow R in FIG. 20. The positions of shutters 503 and 703 on photosensitive drum 137 are indicated by crosshatched portions 751 and 753. When shutter 503 is located within a length 1o from a first edge of photosensitive drum 137, fixed shutter 703 is not positioned over the surface of photosensitive drum 137. When shutter 503 is located beyond the length 1o from the first edge, fixed shutter 703 forms a shadow on the surface of photosensitive drum 137. Since shutter 503 is movable, two shadow portions may thus be formed, either one or both of which the laser beam may be irradiated onto.

Figure 27:
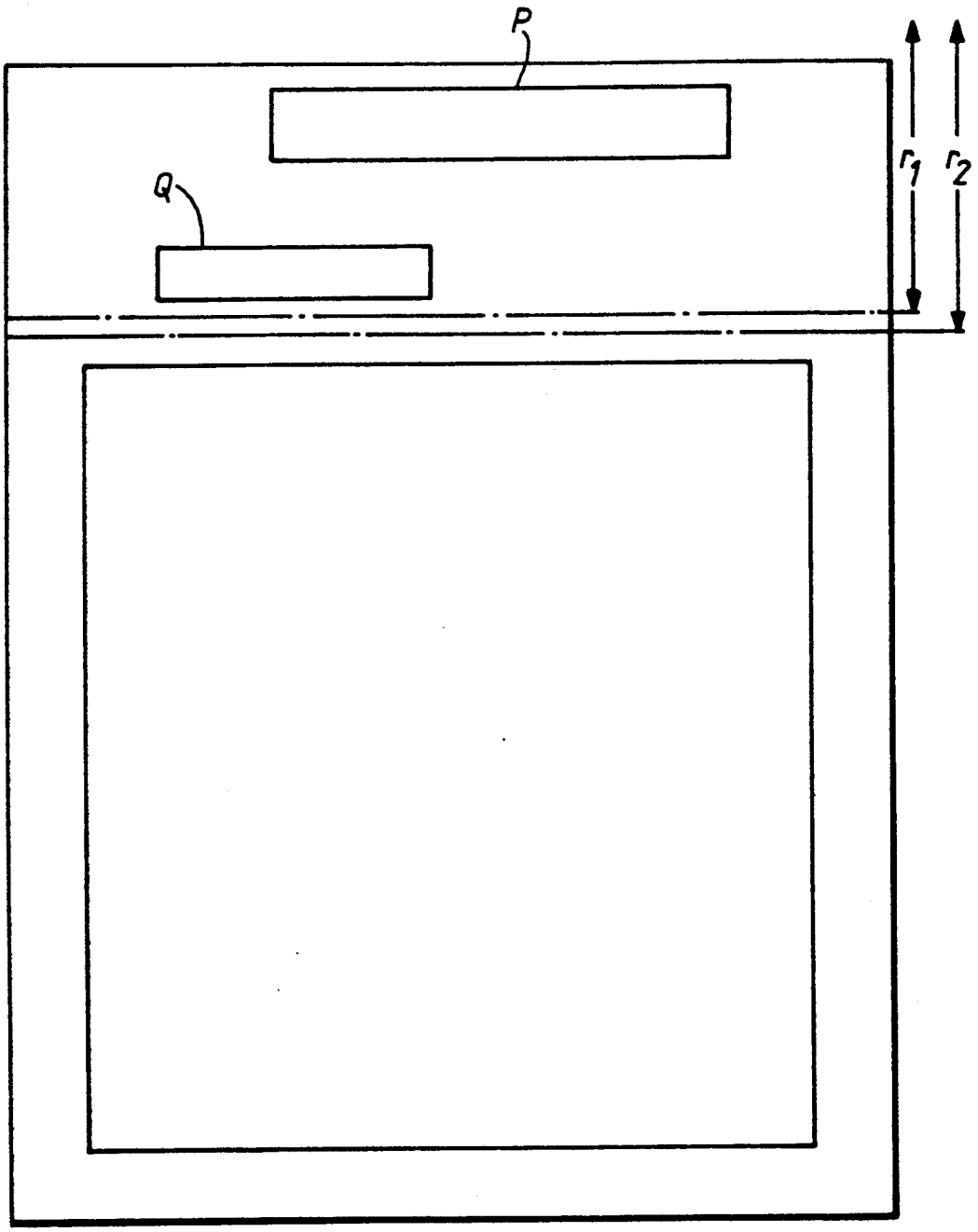

FIG. 27 shows an example with two areas in which the additional information is written. An area P corresponds to fixed shutter 703. An area Q corresponds to shutter 503.

It is desirable that the area P is positioned at the top or bottom of the paper sheet and the area Q is positioned elsewhere on paper sheet. This is because shutter 703 may be moved outside of the optical path when shutter 503 is positioned within the distance 1o from the edge of photosensitive drum 137.

Figure 28:
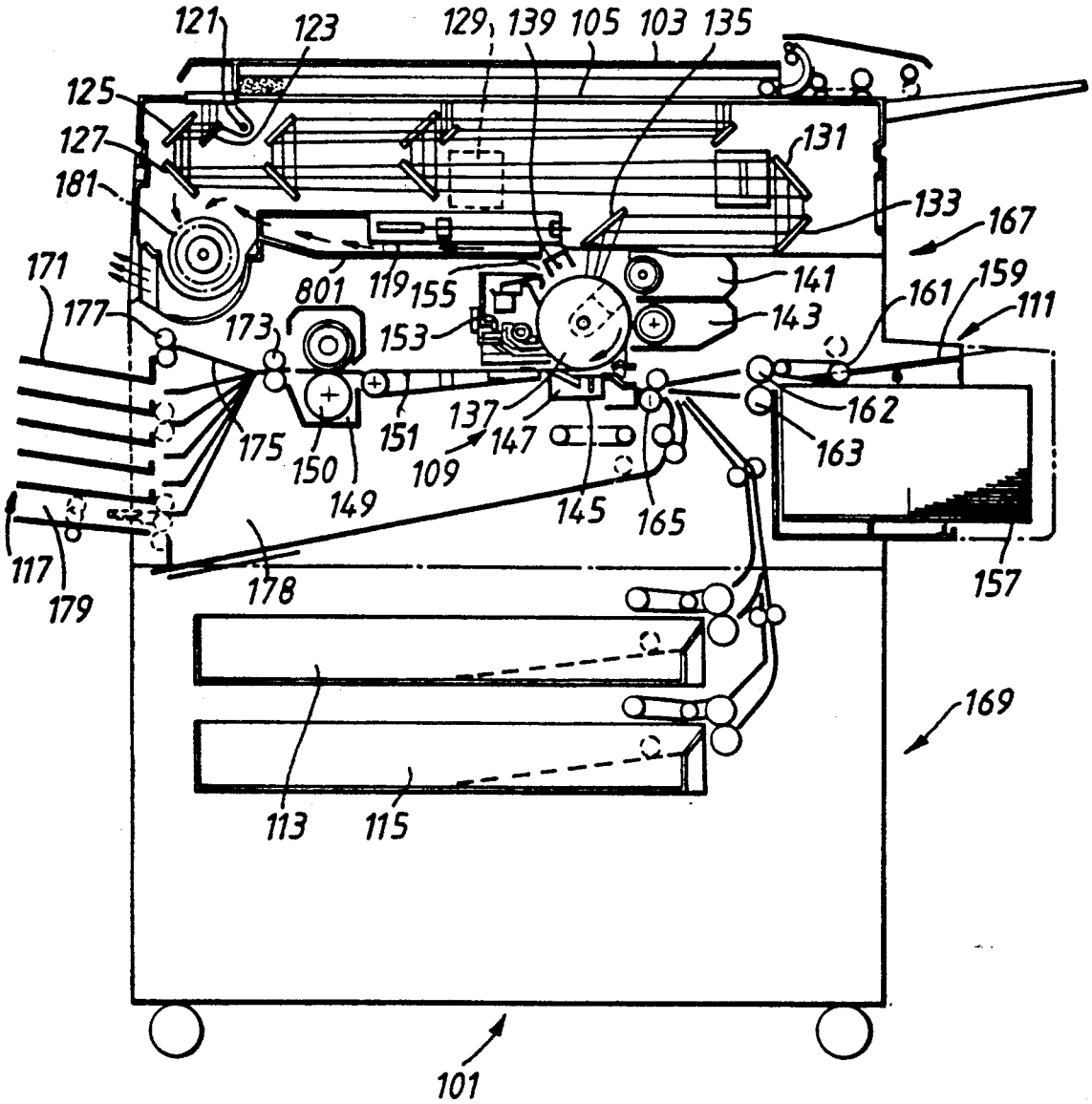
FIGS. 28 and 29 illustrate a third embodiment of the present invention.
Figure 29:
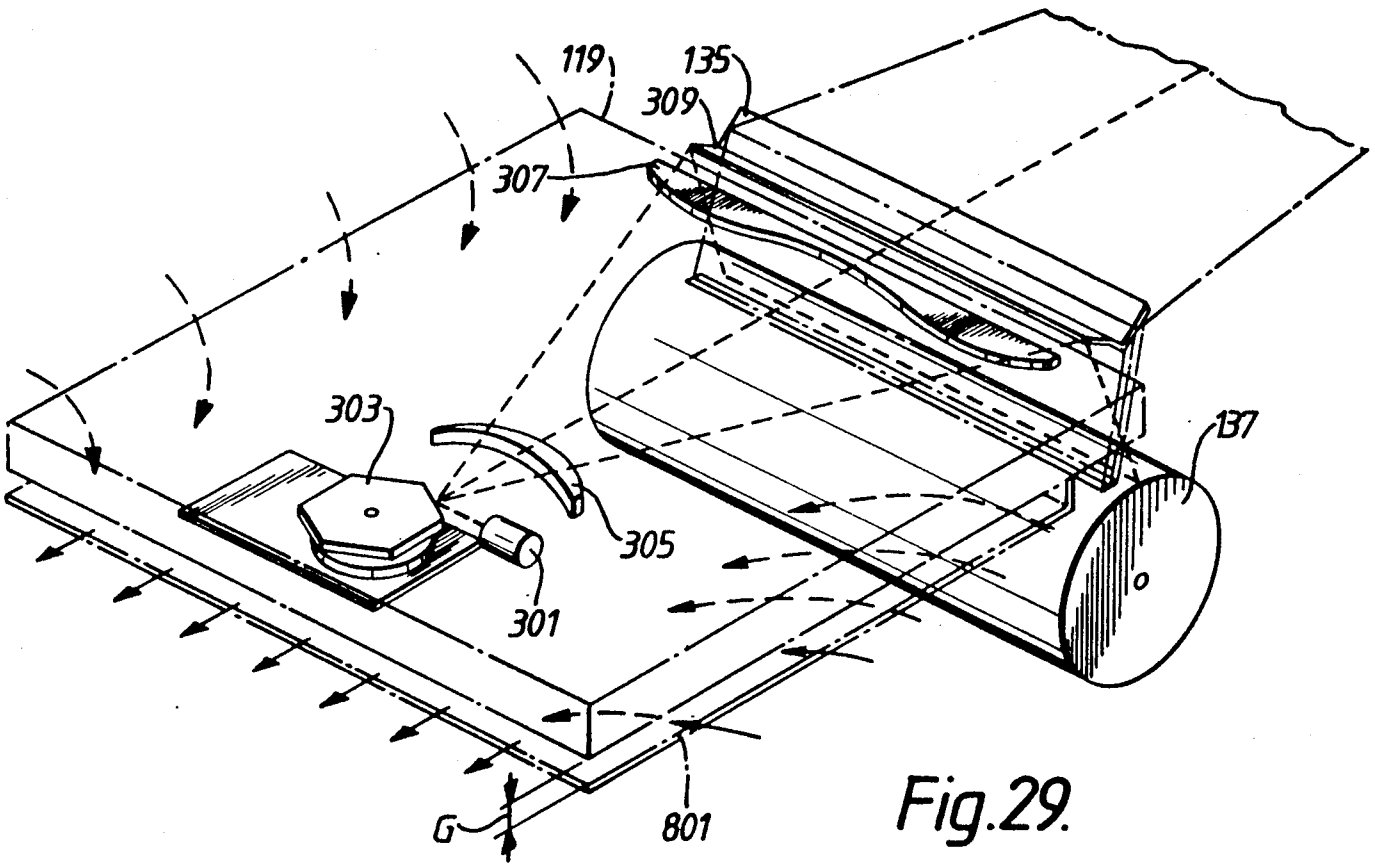

Referring now to FIG. 28 and 29, a third embodiment will be explained. The difference between the first and third embodiment resides in a cooling mechanism for cooling laser unit 119. Under laser unit 119 is deposited a wind guide 801 with a spacing G from laser unit 119 for admitting fresh air into a space between laser unit 119 and wind guide 801. Fixing unit 149, which is deposited under laser unit 119, emits considerable heat which might affect laser unit 119. In particular, lens 305 and 307 are made from plastic material and their characteristics may be modified by heat. According to the present invention, heat from fixing unit 169 is removed by fresh air which flows through the space between laser unit 119 and wind guide 801.

Figure 30:
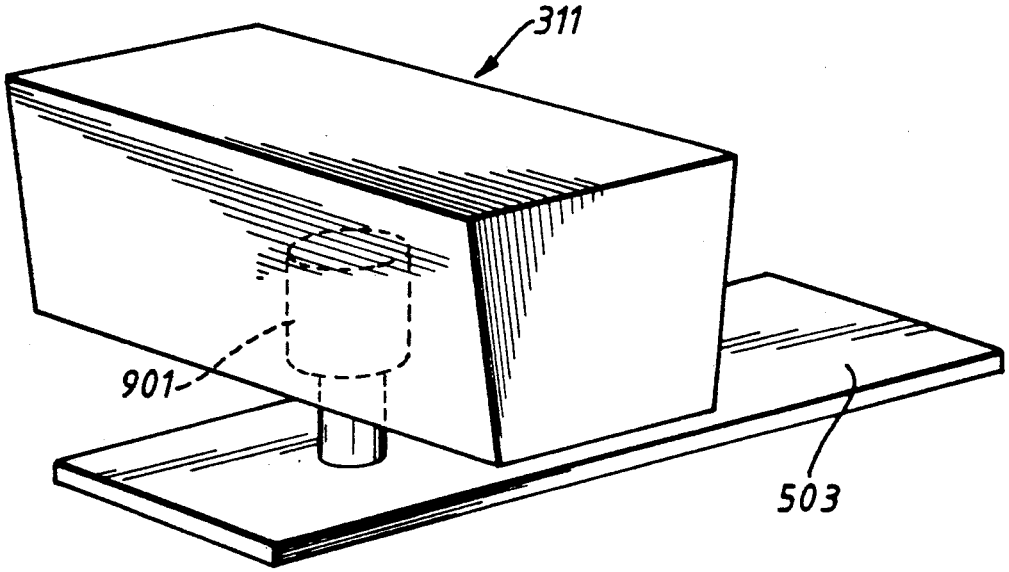
FIGS. 30 and 31 illustrate a fourth embodiment of the present invention.
Figure 31:
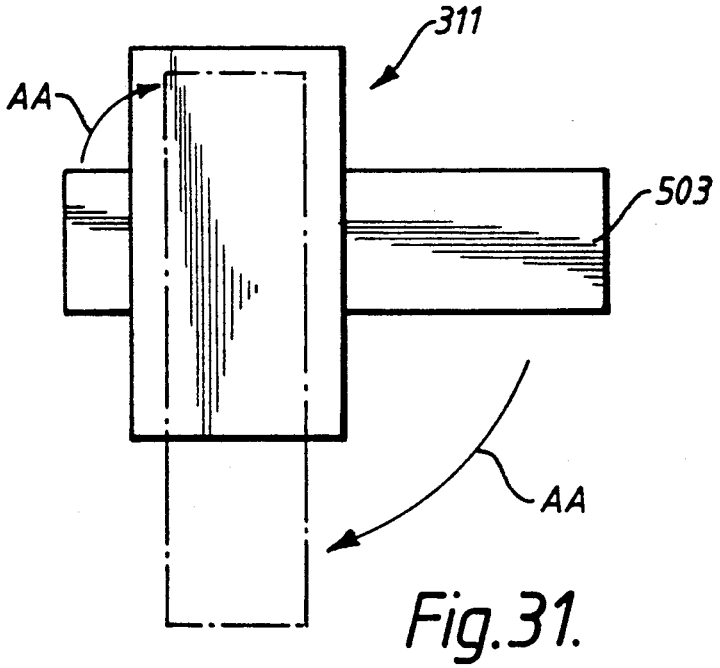

With reference to FIGS. 30 and 31, a fourth embodiment of the present invention will be described. The difference between the first and fourth embodiments resides in shutter unit 311, particularly the mechanism for moving shutter 503. According to the present embodiment, a rotating pulse motor 901 is positioned within shutter unit 311. The rotational axis of rotating pulse motor 901 is perpendicular to the upper surface of shutter 503.

Shutter 503 is rotated in the direction of arrow A—A shown in FIG. 31. In accordance with the rotation of rotating pulse motor 901, shutter 503 is moved from a first position to a second position. Shutter 503 blocks the light reflected from the document at the first position. Shutter 503 does not block light reflected from the document at the second position. It takes a short time for shutter 503 to be moved between the first and the second position and thus the advantages of the first embodiment are retained. This is because the movement of shutter 503 between the first and the second position depends only on the rotation of the rotating pulse motor. As in the second embodiment, a fixed shutter may also be included.

Other objects, features and advantages of the present invention will become apparent from the following detailed description. It should be understood, however, that the detailed description and specific examples while indicating preferred embodiments of the invention, are given by way of illustration only, since various changes and modifications within the spirit and scope of the invention will become apparent to those skilled in the art.

What is claimed is:

1. An image forming apparatus for forming a first image and a second image on a photosensitive material, said image forming apparatus comprising:

first light means for emitting light in accordance with the first image which follows a first path so as to be incident on said photosensitive material;

second light means for emitting light in accordance with the second image which follows a second path so as to be incident on said photosensitive material;

shutter means for selectively blocking the light emitted by said first light means;

control means for controlling the second light means so that the second light means emits light in accordance with the second image onto a shadow portion of said photosensitive material, said shadow portion formed when said shutter means blocks the light emitted by the first light means;

first motor means for selectively moving the shutter means in a first direction in response to position data; and second motor means for selectively moving said shutter means in a second direction perpendicular to the first direction in response to the position data, said second motor means moving said shutter means between a first position outside the first path of light from said first light means and a second position within the first path of light for blocking the light emitted by the first light means.

2. The image forming apparatus of claim 1 wherein said shutter means comprises a shutter plate.

3. The image forming apparatus of claim 2 wherein said second motor means includes:

a motor for rotating a rod;

lever means coupled to said rod and said shutter plate for moving said shutter plate in the second direction in response to the rotation of said rod by said motor.

4. The image forming apparatus of claim 1 wherein an optical axis of the first path is coincident with an optical axis of the second path.

5. The image forming apparatus of claim 1 further comprising:

first input means for supplying data corresponding to the second image to said second light means; and second input means coupled to said second light means and said first and second motor means for supplying position data to determine the position at which the second image is formed on said photosensitive material.

6. The image forming apparatus of claim 1 wherein said first motor means includes a threaded rod and a motor means for rotating said threaded rod and wherein said shutter means includes a threaded opening into which said threaded rod is disposed.

7. The image forming apparatus of claim 1 further comprising:

heat fixing means for fixing the first and second images formed on said photosensitive material by the application of heat; and cooling means disposed between said second light means and the heat fixing means for cooling said second light means.

8. The image forming apparatus of claim 1 wherein said shutter means includes a body portion and a first shutter plate which is movable relative to said body portion.

9. The image forming apparatus of claim 8 wherein said shutter means further includes a second shutter fixed relative to said body portion.

10. The image forming apparatus of claim 1 wherein said first light means includes a first light source for emitting light onto an original document having the first image, first reflecting means for reflecting light from said original document onto said photosensitive material and wherein said second light means includes a second light source for emitting light corresponding to the second image and second reflecting means for reflecting the light emitted by the second light source onto said photosensitive material.

11. The image forming apparatus of claim 10 further comprising:

driving means for moving said first and second reflecting mirrors in order that light emitted by said second light source is incident on said original document.

12. A shutter mechanism for use in an image forming apparatus for forming a first image and a second image on a photosensitive material in accordance with light emitted from respective first and second light sources, said shutter mechanism comprising:

shutter means for selectively blocking light emitted by said first light source;

control means for controlling said second light source so that said second light source emits light in accordance with the second image onto a shadow portion of said photosensitive material, said shadow portion formed when said shutter means blocks the light emitted by said first light source;

first motor means for selectively moving said shutter means in a first direction in response to position data; and second motor means for selectively moving said shutter means in a second direction perpendicular to the first direction in response to the position data, said second motor means moving said shutter means between a first position permitting light from said first light source to be incident on said photosensitive material and a second position for blocking light from said first light source from being incident on said photosensitive material.

13. The shutter mechanism of claim 12 wherein said shutter means comprises a shutter plate.

14. The shutter mechanism of claim 13 wherein said second motor means includes:

a motor for rotating a rod;

lever means coupled to said rod and said shutter plate for moving said shutter plate in the second direction in response to the rotation of said rod by said motor.

15. The shutter mechanism of claim 12 wherein an optical axis of the first path is coincident with an optical axis of the second path.

16. The shutter mechanism of claim 12 further comprising:

first input means for supplying data corresponding to the second image to said second light means; and second input means coupled to said second light means and said first and second motor means for supplying position data to determine the position at which the second image is formed on said photosensitive material.

17. The shutter mechanism of claim 12 wherein said first motor means includes a threaded rod and a motor means for rotating said threaded rod and wherein said shutter means includes a threaded opening into which said threaded rod is disposed.

18. The shutter mechanism of claim 12 further comprising:

heat fixing means for fixing the first and second images formed on said photosensitive material by the application of heat; and cooling means disposed between said second light means and the heat fixing means for cooling said second light means.

19. The shutter mechanism of claim 12 wherein said shutter means includes a body portion and a first shutter plate which is movable relative to said body portion.

20. The shutter mechanism of claim 19 wherein said shutter means further includes a second shutter fixed relative to said body portion.

21. The shutter mechanism of claim 12 wherein said first light means includes a first light source for emitting light onto an original document having the first image, first reflecting means for reflecting light from said original document onto said photosensitive material and said second light means includes a second light source for emitting light corresponding to the second image and second reflecting means for reflecting the light emitted by the second light source onto said photosensitive material.

22. The shutter mechanism of claim 21 further comprising:

driving means for moving said first and second reflecting mirrors in order that light emitted by said second light source is incident on said original document.

23. A method for forming a first image and a second image on a photosensitive material, said method comprising the steps of:

emitting light in accordance with the first image which follows a first path so as to be incident on said photosensitive material;

emitting light in accordance with the second image which follows a second path so as to be incident on said photosensitive material;

selectively blocking the light following the first path with a shutter;

emitting light in accordance with the second image onto a shadow portion of said photosensitive material, said shadow portion formed when said shutter blocks the light following the first light path;

selectively moving the shutter in a first direction in response to position data; and selectively moving said shutter in a second direction perpendicular to the first direction in response to the position data, said shutter moved between a first position permitting light following the first path to be incident on said photosensitive material and a second position blocking light following the first path from being incident on said photosensitive material.

* * * * *